US010156395B2

(12) United States Patent
Roekens et al.

(10) Patent No.: US 10,156,395 B2
(45) Date of Patent: Dec. 18, 2018

(54) INTERMITTENT POWER GRID READY COOLER

(71) Applicant: The Coca-Cola Company, Atlanta, GA (US)

(72) Inventors: Jurgen Roekens, Kampenhout (BE); Roberto Horn Pereira, Suwanee, GA (US); Abram C. Knip, Heemstede (NL); Jacobus P. M. Dessing, Hoofddorp (NL)

(73) Assignee: The Coca-Cola Company, Atlanta, GA (US)

( * ) Notice: Subject to any disclaimer, the term of this patent is extended or adjusted under 35 U.S.C. 154(b) by 48 days.

(21) Appl. No.: 15/104,471

(22) PCT Filed: Dec. 18, 2014

(86) PCT No.: PCT/US2014/071067
§ 371 (c)(1),
(2) Date: Jun. 14, 2016

(87) PCT Pub. No.: WO2015/100119
PCT Pub. Date: Jul. 2, 2015

(65) Prior Publication Data

US 2016/0313046 A1 Oct. 27, 2016

Related U.S. Application Data

(60) Provisional application No. 61/919,904, filed on Dec. 23, 2013.

(51) Int. Cl.

| | |
|---|---|
| ***F25D 16/00*** | (2006.01) |
| ***F25D 11/00*** | (2006.01) |
| ***F25B 39/02*** | (2006.01) |
| ***F25D 25/02*** | (2006.01) |
| ***F25B 5/04*** | (2006.01) |

(Continued)

(52) U.S. Cl.
CPC ..... *F25D 16/00* (2013.01); *A47F 3/043* (2013.01); *F25B 5/04* (2013.01); *F25B 39/02* (2013.01); *F25D 3/00* (2013.01); *F25D 11/006* (2013.01); *F25D 25/028* (2013.01); *F25B 2400/24* (2013.01)

(58) Field of Classification Search
CPC ..... F25B 5/04; F25B 41/04; F25B 2400/06; F25B 39/02; F25B 2400/24; F25B 1/00; F25D 3/00; F25D 16/00; F25D 11/006; F25D 25/028; A47F 3/043
USPC ..... 62/336, 258, 89
See application file for complete search history.

(56) References Cited

U.S. PATENT DOCUMENTS 1,883,961 A * 10/1932 Kosmerl ..... A47F 3/0404 312/296
2,418,062 A * 3/1947 Abrahamson ..... A47F 3/0486 312/125

(Continued)

FOREIGN PATENT DOCUMENTS

EP 0098052 1/1984

*Primary Examiner* — Marc Norman
(74) *Attorney, Agent, or Firm* — Eversheds Sutherland (US) LLP

(57) ABSTRACT

The present application provides a cooler. The cooler may include an outer frame, a product space within the outer frame, and a number of shelf assemblies positioned within the product space. The shelf assemblies may include an evaporator and a phase change material therein.

13 Claims, 17 Drawing Sheets

(51) Int. Cl.
*A47F 3/04* (2006.01)
*F25D 3/00* (2006.01)

(56) References Cited

U.S. PATENT DOCUMENTS

| | | | | |
|---|---|---|---|---|
| 4,002,384 | A * | 1/1977 | Brown | A47B 77/10 312/111 |
| 4,580,412 | A | 4/1986 | Wells | |
| 5,505,046 | A * | 4/1996 | Nelson | F25B 21/02 165/236 |
| 7,797,950 | B2 | 9/2010 | Brower et al. | |
| 2006/0238091 | A1* | 10/2006 | Linke | E05C 19/02 312/405 |
| 2010/0242514 | A1* | 9/2010 | Ramos De La Fuente | A47F 3/0404 62/255 |
| 2011/0036744 | A1* | 2/2011 | Rubin | B65D 1/36 206/562 |
| 2011/0239675 | A1 | 10/2011 | Roekens | |
| 2012/0291469 | A1 | 11/2012 | Li et al. | |
| 2013/0081666 | A1* | 4/2013 | Yoon | H01L 25/0753 136/205 |
| 2015/0297000 | A1* | 10/2015 | Gomes | A47F 3/0447 62/255 |

* cited by examiner

INTERMITTENT POWER GRID READY COOLER

TECHNICAL FIELD

The present application and the resultant patent relates generally to refrigeration systems and more particularly relate to a cooler such as a glass door merchandiser that may accommodate intermittent power while maintaining the products therein cooled and appealing.

BACKGROUND OF THE INVENTION

Although modern merchandisers, coolers, vending machines, and the like offering beverages and other types of products may seem ubiquitous, many retail establishments throughout the world still rely on ice chests to keep the products therein cooled. For example, a constant and reliable supply of electrical power may not be available in many countries. The use of conventional ice chests, however, often results in inconsistent product quality. Moreover, ice chests generally do not drive impulse purchases because the consumer cannot see the products therein. Even if the consumer had the opportunity to see the products within the cooler, however, a dark cooler may imply the lack electrical power in situ and thus a lack of a properly cooled product therein. The use of large ice blocks may keep the products therein cool for a longer period of time, but such ice blocks may be difficult to handle and generally may be positioned at the top of a cooler such that the cooler as a whole may be unstable and/or have a large footprint.

There is thus a desire for an improved cooler such as a glass door merchandiser and the like. Preferably, such a cooler may accommodate intermittent electric power while maintaining the products therein in a cooled condition for an extended period of time. Moreover, the cooler may have an improved energy efficient configuration with improved merchandising capability so as to indicate the presence of cooled products therein.

SUMMARY OF THE INVENTION

The present application and the resultant patent thus provide a cooler. The cooler may include an outer frame, a product space within the outer frame, and a number of shelf assemblies positioned within the product space. The shelf assemblies may include an evaporator and a phase change material therein.

The present application and the resultant patent further provide a method of operating a cooler with intermittent power. The method may include the steps of positioning a number of shelf assemblies within the cooler wherein the shelf assemblies include a phase change material and an evaporator therein, circulating a refrigerant about the phase change material when the power is on, freezing the phase change material, and maintaining the cooler in a chilled condition for an extended period of time when the power is off by melting the phase change material.

The present application and the resultant patent further provide a cooler.

The cooler may include an outer frame, a product space within the outer frame, and a number of products shelves positioned within the product space and adapted to support a number of products. The product space may include a substantially hexagonal shape. The products may be arranged in a zig-zag configuration.

The present application and the resultant patent further provide a cooler with a number of products therein. The cooler may include an outer frame, a product space positioned within the outer frame, and a Seebeck indicator in thermal communication with the outer frame and the product space so as to indicate the presence of cooled products therein.

The present application and the resultant patent further provide a cooler. The cooler may include an outer frame, a product space with a substantially hexagonal shape within the outer frame, a number of products arranged in the product space in a zig-zag configuration, and one or more replaceable phase change material packs positioned about the product space.

The present application and the resultant patent further provide a cooler with a number of products therein. The cooler may include an outer frame, a product space within the outer frame, and a number of shelf assemblies positioned within the product space with the shelf assemblies including an evaporator and a phase change material therein, a top shelf assembly positioned about a top of the product space, and wherein the shelf assemblies form a number of self-contained shelf chambers.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
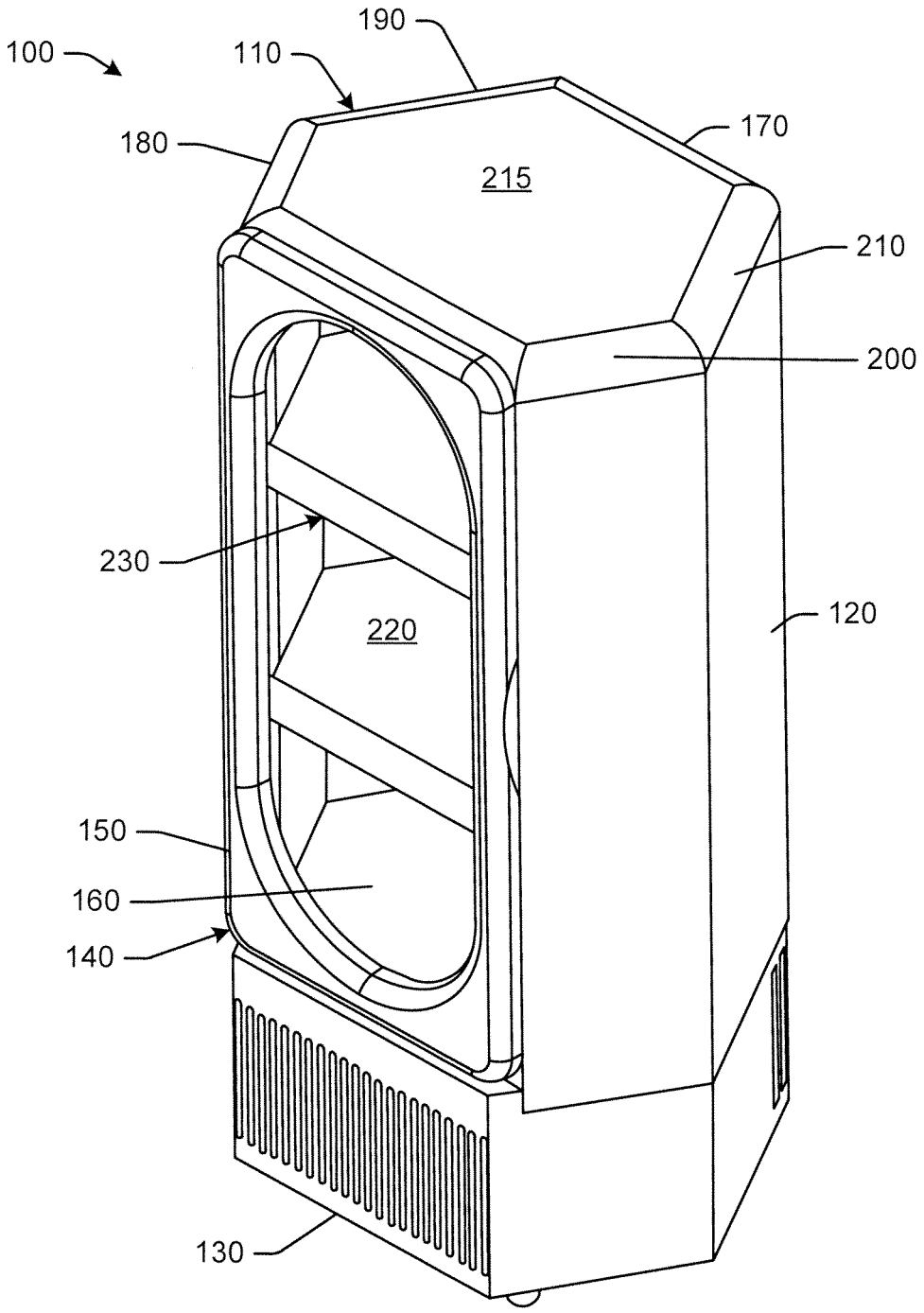
FIG. 1 is a perspective view of an example of a cooler as may be described herein.
Figure 2:
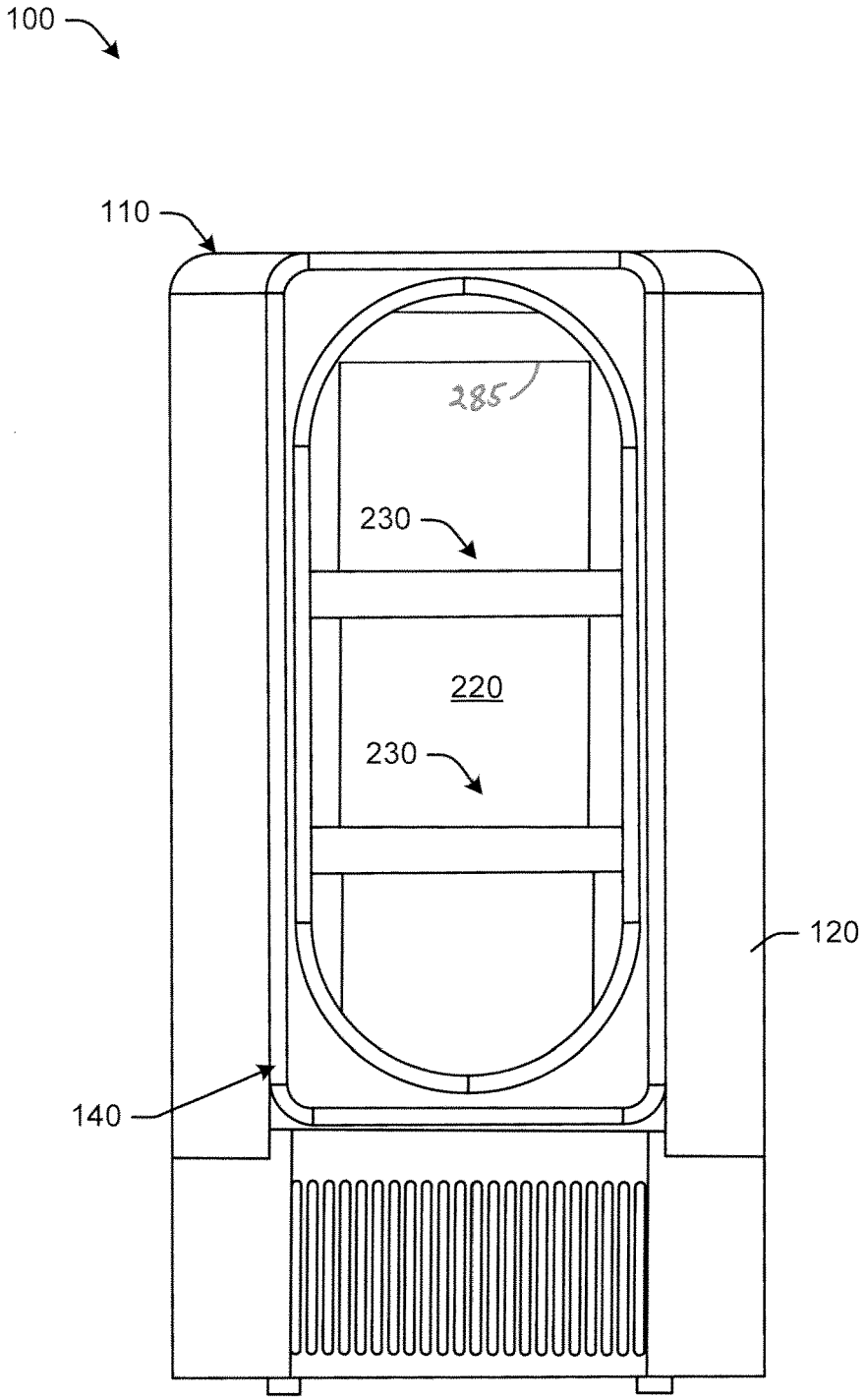
FIG. 2 is a front plan view of the cooler of FIG. 1.
Figure 3:
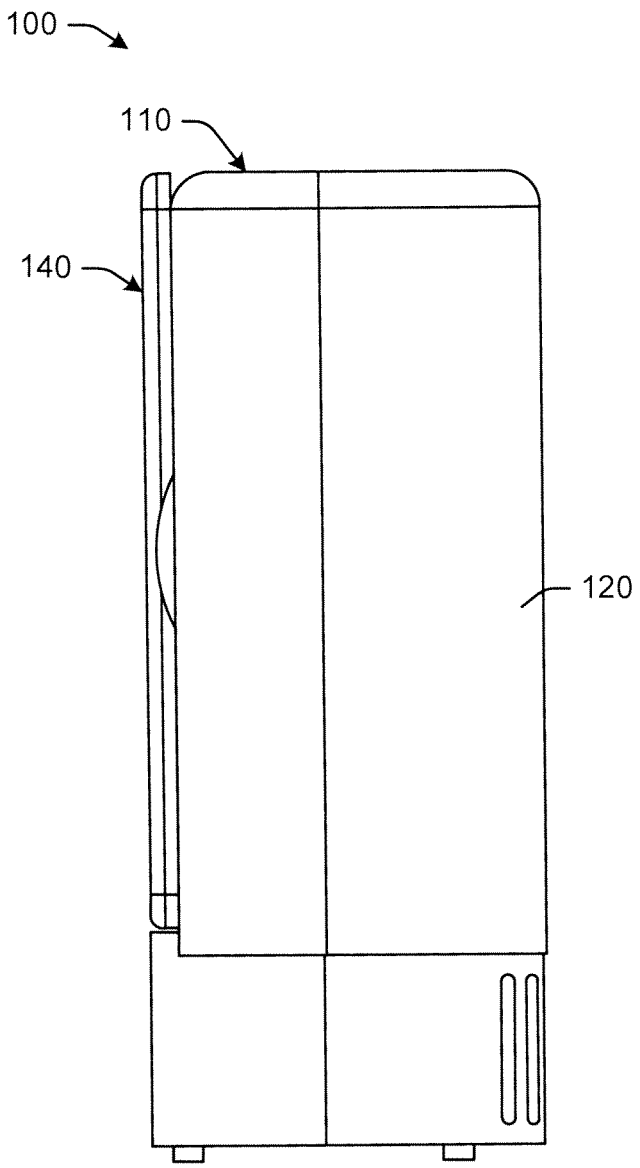
FIG. 3 is a side plan view of the cooler of FIG. 1.
Figure 4:
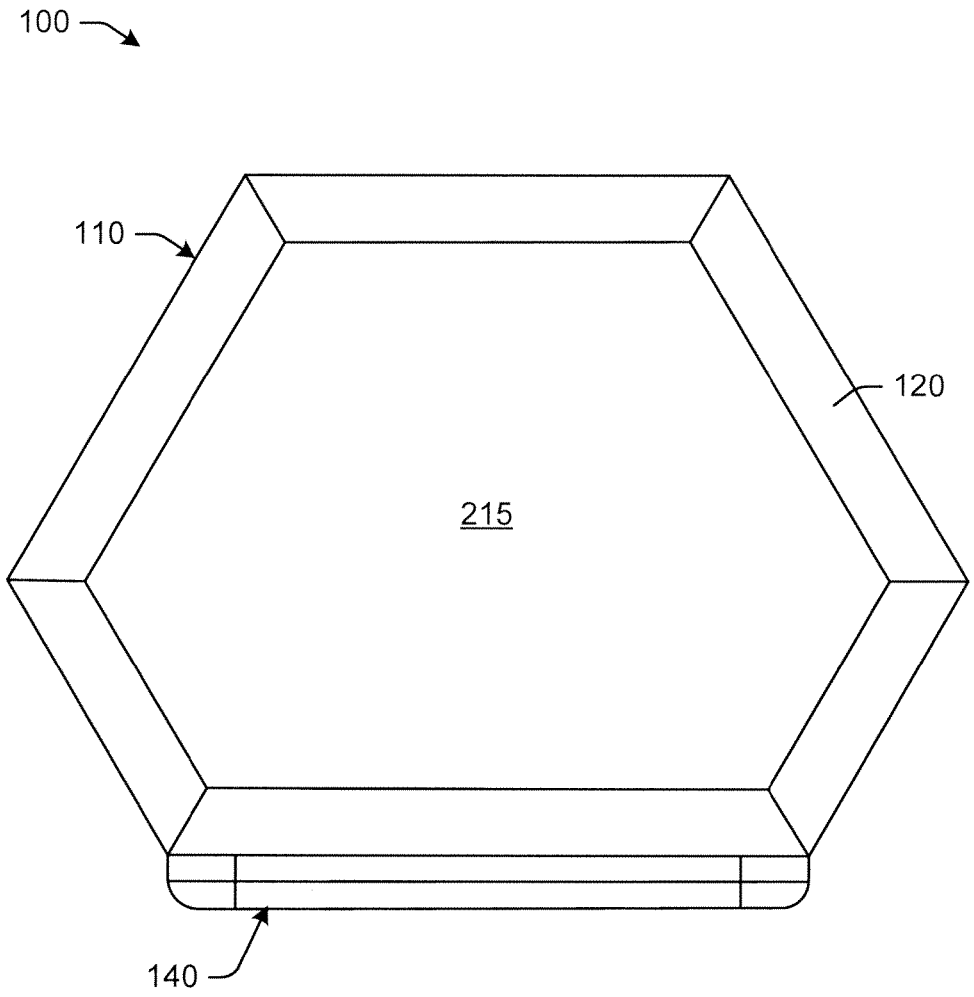
FIG. 4 is a top plan view of the cooler of FIG. 1.

The present application and the resultant patent concern the offering for sale of any number of products 10. Although the products 10 are shown, by way of example only, in the form of bottles, it is understood that the products 10 may include any type or size of item or package including, but not limited to, bottles, cans, pouches, boxes, wrapped items, produce, and/or any type of rigid or flexible packaging. The products 10 may include beverages, food items, non-food items, consumer products, and/or any type of product. The scope of the application herein is in no way limited by the nature of the products 10 described herein.

Referring now to the drawings, in which like numerals refer to like elements throughout the several views, FIGS. 1-6 show an example of a cooler 100 as may be described herein. In this example, the cooler 100 may be a hexagonally-shaped cooler 110. The cooler 100, however, may have any suitable size, shape, or configuration and may hold any number of the products 10 therein.

The hexagon cooler 110 thus may include an outer frame 120 with six sides. The outer frame 120 may be insulated in whole or in part. A first side 130 of the hexagon cooler 110 may include a door 140. The door 140 may include a door frame 150 surrounding a transparent panel 160. The transparent panel 160 may be made out of glass, acrylics, and the like. The door frame 150 may have the rounded corners as is shown for a reduced overall size. The door 140 may have a gasket seal and the like for good efficiency. Any number of doors 140 may be used herein in any suitable size, shape, or configuration. An anti-condensation foil may be positioned about the transparent panel 160. The hexagon cooler 110 also includes a second side 170 or a rear panel, a third side 180 and a fourth side 190 as a left hand side, and a fifth side 200 and a sixth side 210 as a right hand side. The corners between the sides may be sharp or rounded. A top panel 215 also is shown with the hexagon shape. The respective sides and panels may have any suitable size, shape, or configuration.

The hexagon cooler 110 also defines an interior product space 220. The product space 220 also may be hexagonally shaped. The product space 220, however, may have any suitable size, shape, or configuration and may hold any number of the products 10 therein. The product space 220 may be refrigerated in whole or in part. A number of shelf assemblies 230 may be positioned within the product space 220. Any number of the shelf assemblies 230 may be used herein. In this example, the shelf assemblies 230 also may adapt to the hexagon shape in whole or in part. Shelf assemblies 230 of differing configurations also may be used together herein. The shelf assemblies 230 will be described in more detail below. Other components and other configurations may be used herein.

Figure 5:
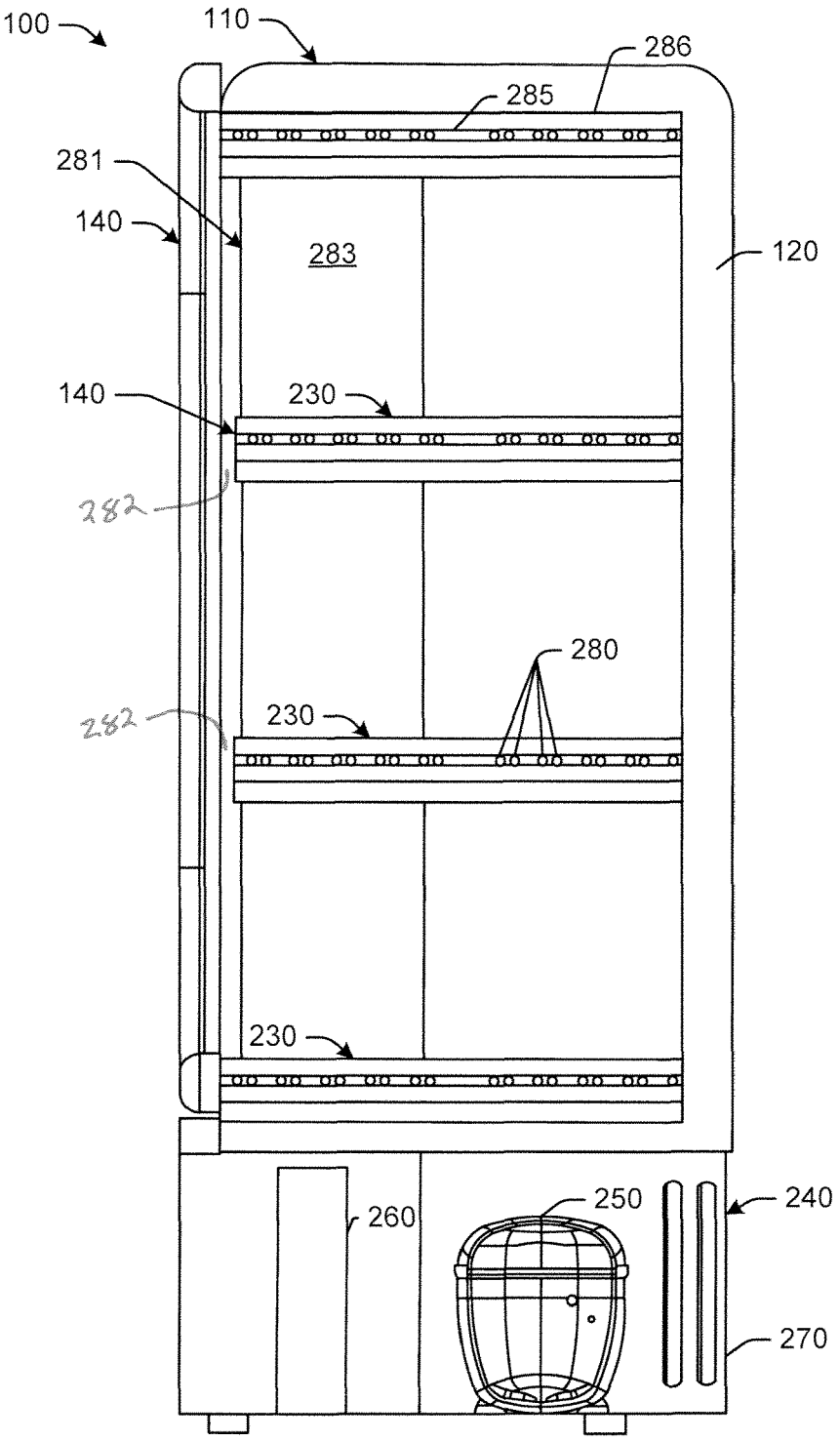
FIG. 5 is a side cross-sectional view of the cooler of FIG. 1 showing a refrigeration system.

FIG. 5 shows an example of a refrigeration system 240 for use with the cooler 100. The refrigeration system 240 may include a compressor 250 and a condenser with a fan 260 positioned about a base 270 of the outer frame 120 or elsewhere. For example the condenser and the fan 260 also may be positioned on top of the outer frame 120 so as reduce overall dust intake and the possibility of clogging. The compressor 250 and the condenser with the fan 260 may be of conventional design and may run on a conventional electrical power source. The refrigeration system 240 also may include a number of evaporator coils 280. The evaporator coils 280 may be positioned in one or more of the shelf assemblies 230. The evaporator coils 280 may be of conventional design. Any number of the evaporator coils 280 may be used herein. The evaporator coils 280 also may be positioned in the outer frame 120 or elsewhere within the cooler 100. The refrigeration system 240 also may include a top evaporator coil 285 positioned at a top portion 286 of the refrigerated product space 220. The refrigeration system 240 may circulate a refrigerant between the evaporator coils 280 and the compressor 250 in a conventional refrigeration cycle. Any type of refrigerant may be used herein. Likewise, any type of refrigeration cycle may be used. The compressor 250, the condenser, the fan 260, and other components of a single refrigeration system 240 may be used with multiple coolers 100. Other components and other configurations also may be used herein.

Figure 6:
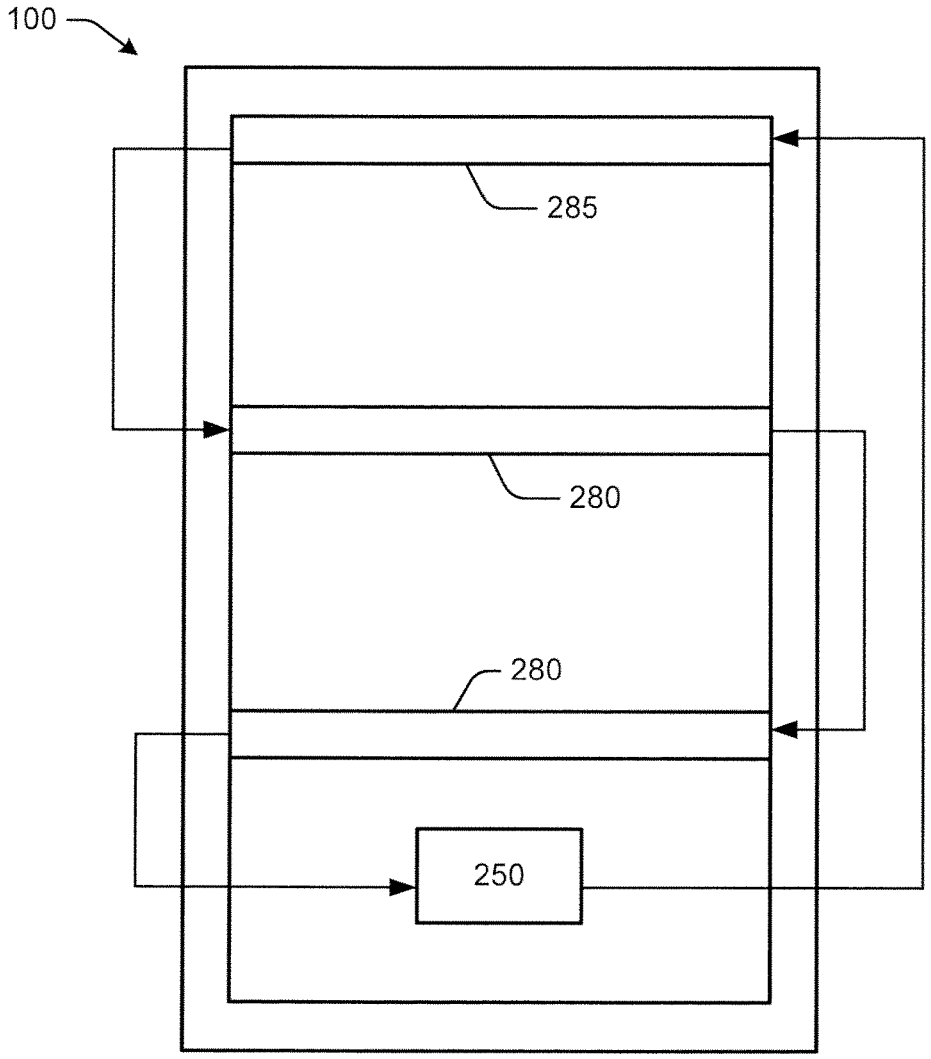
FIG. 6 is a schematic diagram of the refrigeration system showing the evaporator coils positioned in series.
Figure 7:
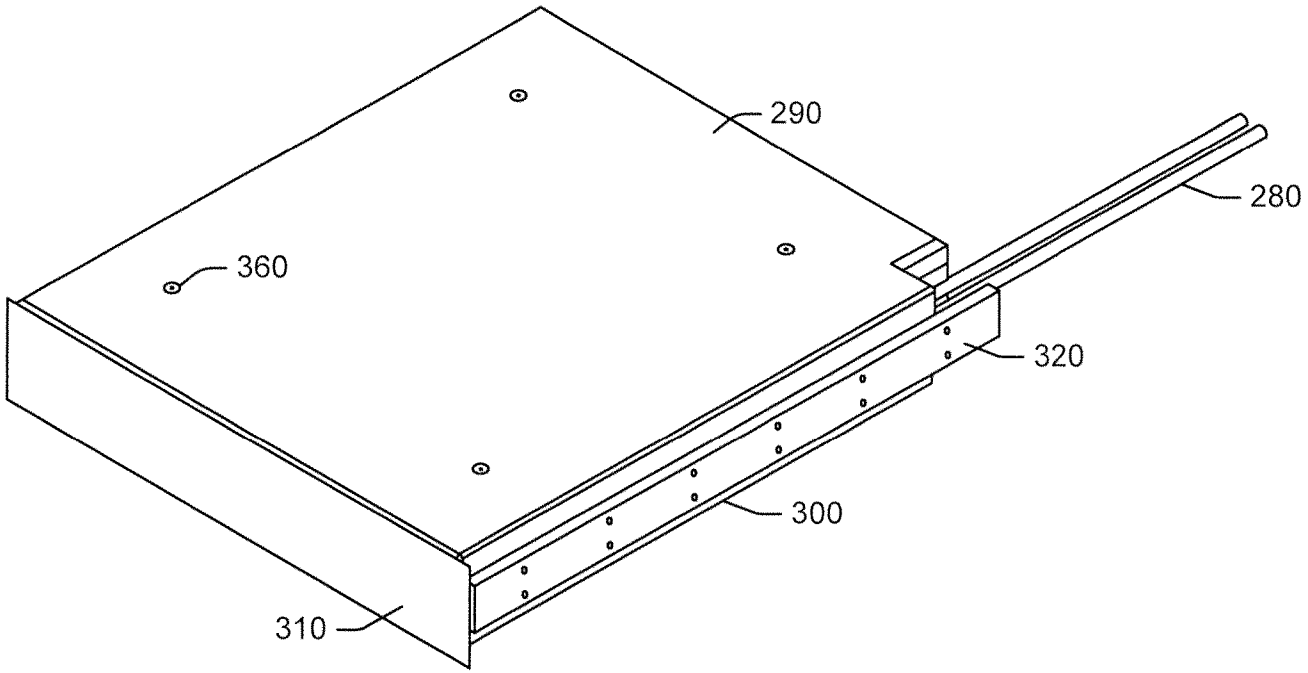
FIG. 7 is a perspective view of a shelf assembly for use with the cooler of FIG. 1.
Figure 8:
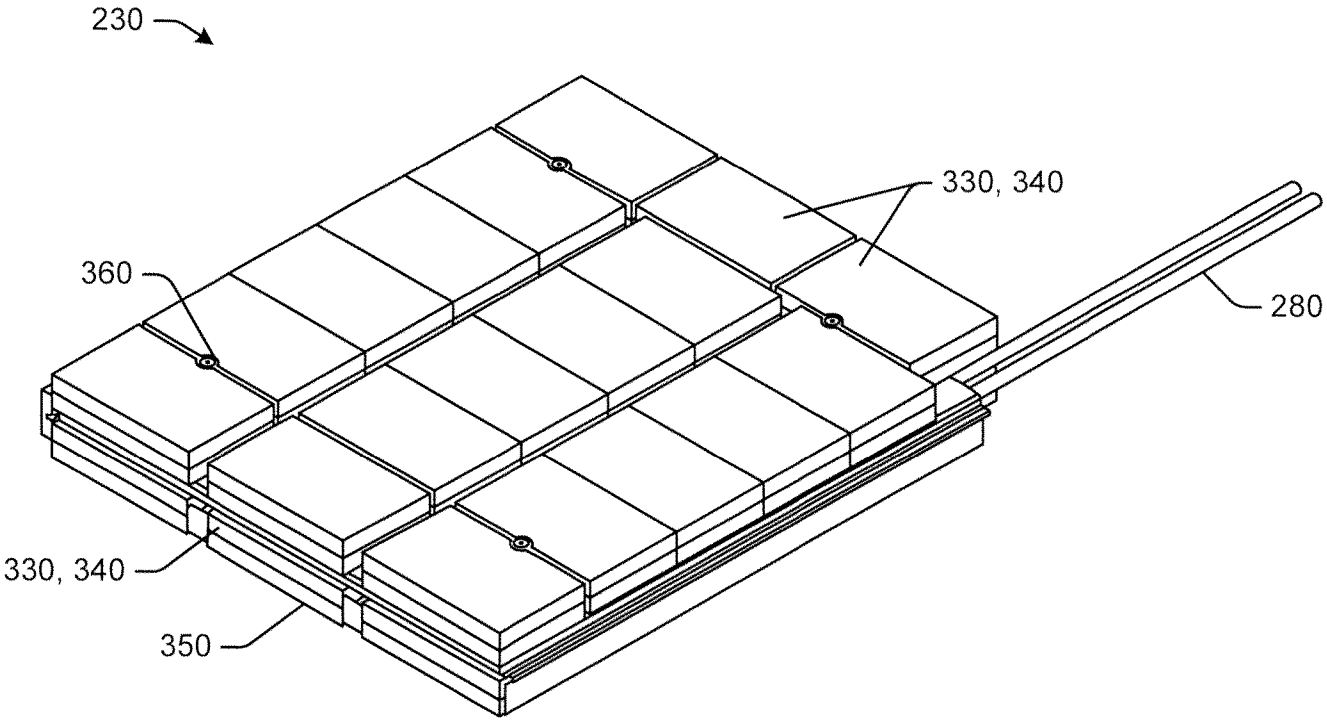
FIG. 8 is a further perspective view of the shelf assembly of FIG. 6 showing a number of phase change material cells.
Figure 9:
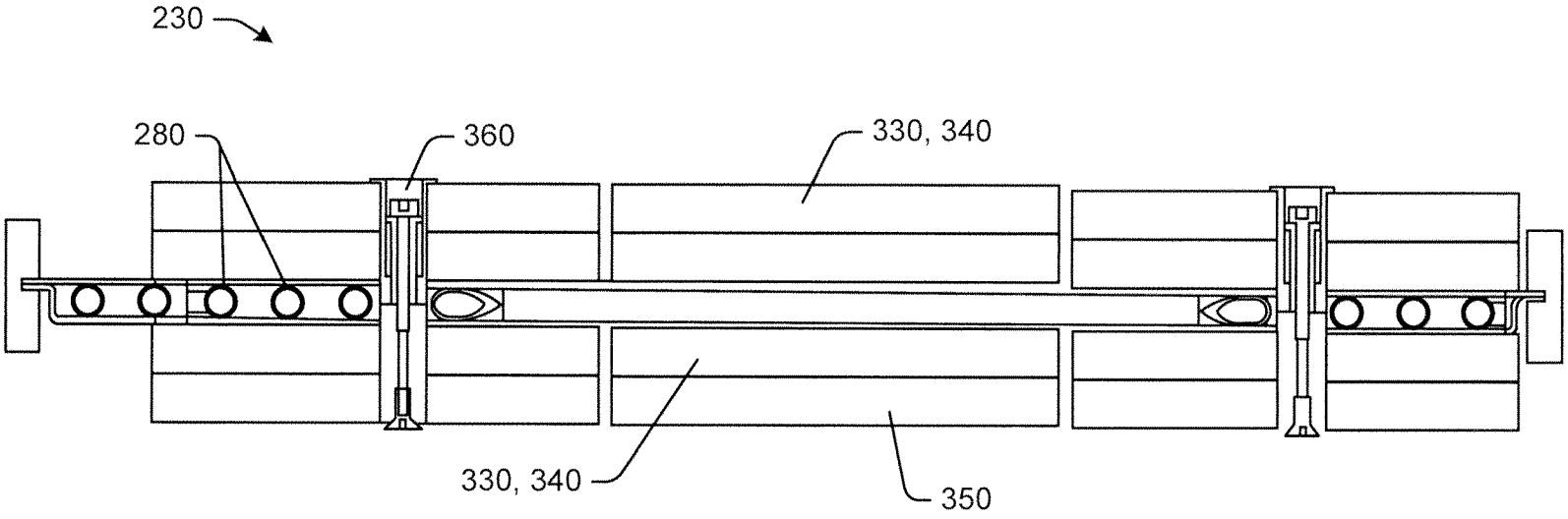
FIG. 9 is a side cross-sectional view of the shelf assembly with the phase change material cells of FIG. 7.
Figure 10:
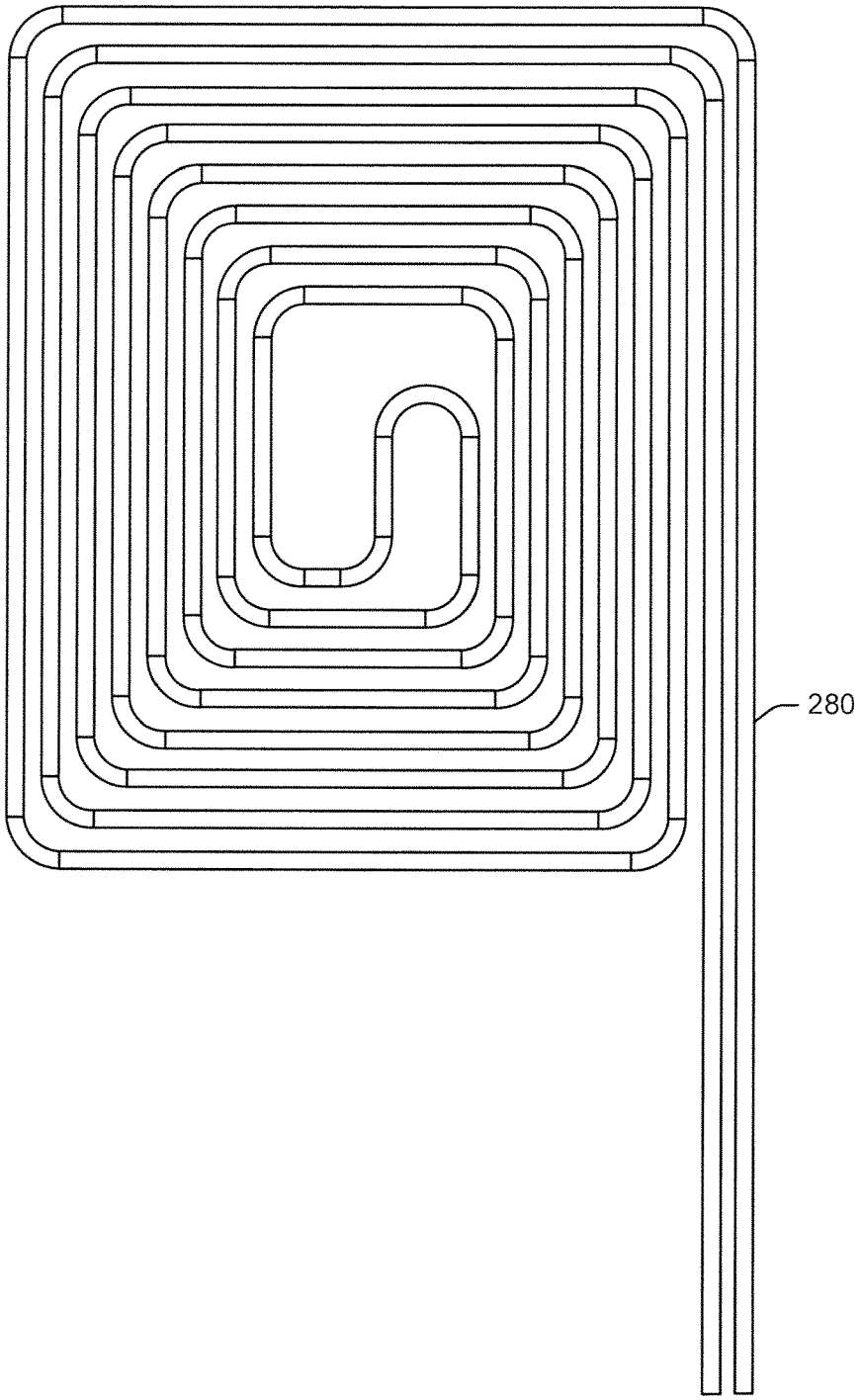
FIG. 10 is a top plan view of the evaporator coil of the shelf assembly of FIG. 6.

FIG. 6 shows the arrangement of the evaporator coils 280 within the refrigeration system 240. The evaporator coils 280 may be arranged in series. Specifically, the refrigerant may flow from the compressor 250 to the condenser 260 and the expansion device and then to the evaporator coils 280. The refrigerant may flow from the top evaporator coil 285 and then downward through each evaporator coil 280 before returning to the refrigeration components. The refrigeration system 240 also may arrange the evaporator coils 280 in a parallel arrangement or otherwise. Other components and other configurations may be used herein.

Referring again to FIG. 5, the product space 220 thus may be divided into a number of shelf chambers 281. Each shelf chamber 281 may have an evaporator coil 280 on top and bottom thereof. Each shelf chamber 281 may be largely self-contained. Specifically, each shelf assembly 230 may extend close to the door 140 such that only a small gap 282 may exist between the end of the shelf assembly 230 and the door 140. The gap 282 may be as small as about one millimeter or so. The size of the gap 282 may be varied by applying, for example, a pricing strip and the like at the end of the shelf assembly 230. The gap 282 may be small enough so as to implead significantly any airflow therethrough when the door 140 is closed. Other types of separation devices may be used herein. Alternatively, each shelf chamber 281 may have its own door. This arrangement also would prevent the loss of cold air from the other chambers 281. Other components and other configurations may be used herein.

FIGS. 7-10 show an example of the shelf assembly 230. Although the shelf assembly 230 is shown as being rectangular, any shape including the hexagonal shape may be used herein. The shelf assembly 230 may include a top surface 290 and a bottom surface 300. The surfaces 290, 300 may be made out of thin metals and the like with good heat transfer characteristics. The front of the shelf assembly 230 may include the pricing strip or a header 310. The header 310 may have pricing, advertising and other types of indicia thereon. The shelf assembly 230 may be positioned within the product space 220 by a pair of rails 320 or other types of support elements and the like. Other components and other configurations may be used herein.

The shelf assembly 230 may include a number of phase change material cells 330. The phase change material cells 330 may be positioned on the top and/or the bottom of the evaporator coils 280 and within the surfaces 290, 300. The phase change material cells 330 may be made out of a somewhat flexible material so as to accommodate thermal expansion and contraction therein. Any number of the phase change material cells 330 may be used. The phase change material cells 330 may have any suitable size, shape, or configuration. The phase change material cells 330 may include a phase change material 340 therein. Alternatively, the phase change material 340 may be positioned in a single cell or container. The phase change material 340 may be water, brine, a water and glycol mixture, and the like. The phase change material 340 may be selected based upon its freezing point. In other words, the freezing point of the phase change material 340 ensures that the products 10 do not fall below the freezing point and freeze themselves. The shelf assembly 230 may have one or more layers of insulation 350 positioned about the phase change material cells 330. The shelf assembly 230 may be held together by a number of spring loaded bolts 360. The spring loaded bolts 360 also may accommodate the thermal expansion and contraction of the phase change material cells 330. (The shelf assembly 230 also may be mounted without the springs if the phase change material cells 330 are relatively thin (e.g., less than about 25 millimeters). The expansion of the phase change material would therefore be somewhat limited.) The phase change material cells 330 also may be an open structure foam material soaked with water or other type of phase change material 340 so as to reduce expansion during freezing. Other components and other configurations may be used herein.

By placing the phase change material 340 in direct contact with the evaporator coils 280, the overall thermal load on the refrigeration system 240 may be increased. With this increase, greater flexibility may be possible with the selection of the compressor 250 and other refrigeration components. Specifically, the compressor 250 need not be sized according to the size or load on the cooler 100. A larger compressor 250 may quickly freeze the phase change material 340 for steady state cycles that may have a short on time period and a long off time period for improved efficiency. The use of the larger compressor need not increase overall energy demands given the use of the phase change material 340, i.e., all of the power draw is absorbed by the coldness of the phase change material 340.

In use, the refrigeration system 240 operates when electrical power is available. Specifically, the evaporator coils 280 freeze the phase change material 340 in the phase change material cells 330 of the shelf assemblies 230. The shelf assemblies 230 thus chill the air in the air in each of the shelf chamber 281 via the frozen phase change material 340. The heat exchange between the air and the products 10 thus causes the products 10 to be chilled. The compressor 250 and the refrigeration system 240 may be turned off when the phase change material 340 has solidified. The chilled condition may be between about two to about six degrees Celsius with about four degrees Celsius or so preferred. Moreover, the phase change material cells 330 may maintain the products 10 in a chilled condition for an extended period of time even when electrical power is lost. Specifically, the phase change material 340 maintains the products 10 in a chilled condition as the phase change material 340 melts. The cooler 100 thus performs as an ice chest in the absence of electrical power. The phase change material 340 then may be refrozen by the refrigeration system 240 when the power is restored. About three to six hours of electrical power per day may be sufficient to maintain the products 10 within the cooler 100 in a chilled condition or at least close to the preferred temperature range for an extended period of time.

Figure 11:
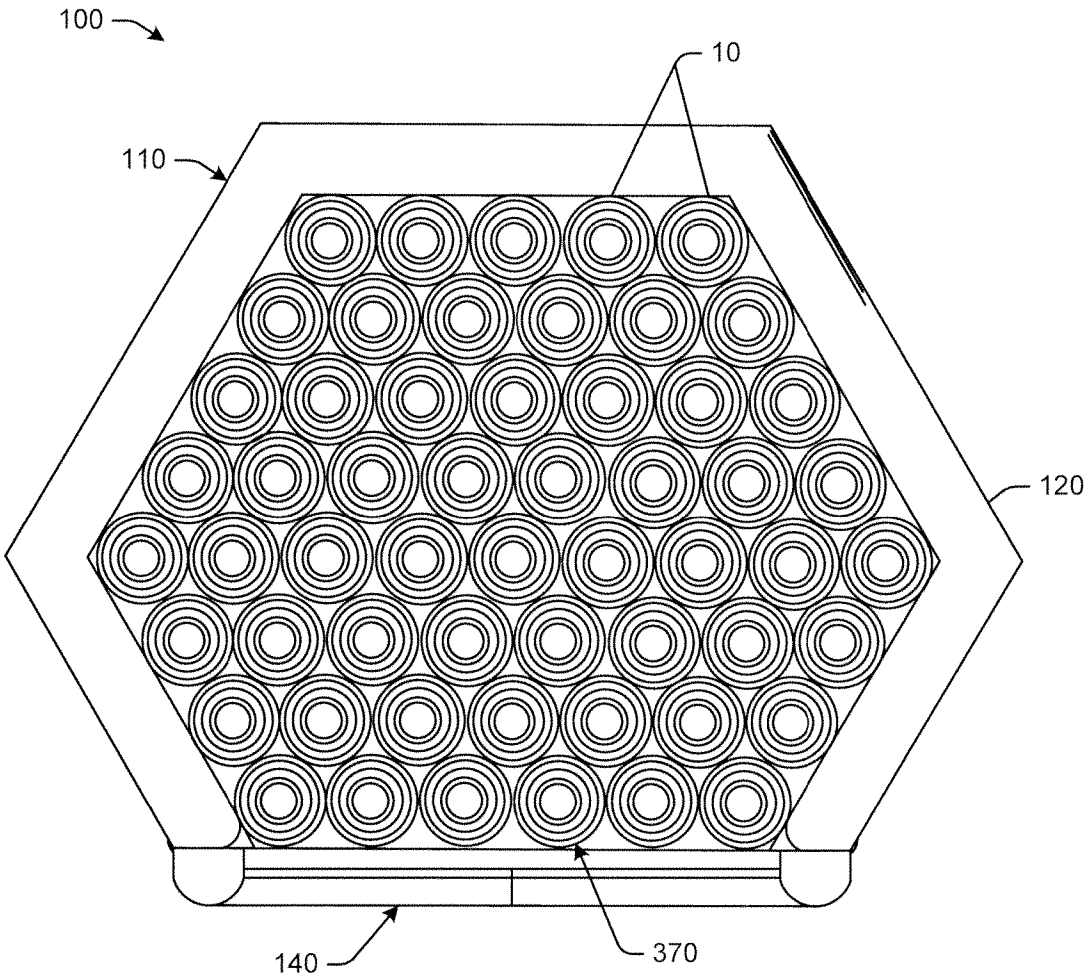
FIG. 11 is a top sectional view of the cooler of FIG. 1 showing the products therein in a zig-zag configuration.

Moreover, by dividing the product space 220 into a number of the self-contained shelf chambers 281, each shelf chamber 281 acts as its own ice chest to avoid or limit heat stratification from top to bottom. Specifically, each shelf chamber 281 may have an evaporator coil 280 on the top and bottom thereof so as to cool the shelf chamber 281. The small gap 282 between each shelf assembly 230 and the door 140 thus prevents migration of warm air between the shelf chambers 281. As a result, the top shelf chamber 283 with the top evaporator coil 285 remains as cold as the lower shelf chambers 281 even when the power is off FIG. 11 shows an example of a number of the products 10 loaded within the hexagon cooler 110 in a zig-zag product arrangement 370 of the bottles or cans, pouches, boxes, and the like. The overall efficiency of the hexagon cooler 110 may be based in part on parameters such as product density, i.e., how tightly the products 10 may be packed therein, as well as the amount of leakage through the outer frame 120. Conventional coolers with a substantially square shape would have more overall surface area as compared to the hexagon shape. More surface area, however, generally leads to more heat transfer loses. The hexagon cooler 110 thus may have less overall surface area and particularly less inside surface area. Other factors influencing overall efficiency may include the size of the door 140, the nature of the gasket seal, and the nature of the insulation within the outer frame 120.

The volume of the product space 220 thus may be sized and configured to maximize the number of products 10 that may be positioned on each of the shelf assemblies 230. The intended size and configuration may vary depending upon the size and shape of the intended products 10 to be positioned therein. The zig-zag product arrangement 370 shown in FIG. 11 provides good product density within the product space 220 and hence a good volume (number of products) to surface ratio. The use of the zig-zag product arrangement 370 within the hexagon cooler 110 thus may decrease the cooler load per product (watt-hour/product) for the hexagon cooler 110 as compared to a conventional square shaped cooler by about twenty percent (20%) or more. Such an increase in efficiency further reduces the overall energy needs of the hexagon cooler 110. Moreover, such an improved product load also may increase the length of time that the products 10 within the cooler 100 may remain chilled in the absence of electrical power. Other types of bottle configurations also may be used herein.

The hexagon cooler 110 may provide improved pull down or make cold capability as well as improved keep cold capability. Moreover, the refrigeration system 240 needs no type of air movement device within the product space 220 for a further increase in efficiency. (Although a fan or other type of air movement device may aid in the overall pull down capability when power is available as well reducing temperature stratification.) The hexagon cooler 110 thus provides the phase change material cells 330 for cooling in an overall configuration having less surface area but with improved product density for efficient long term operation even without reliable power.

Such an increase in product load may represent a considerable reduction in energy usage and overall energy costs. Specifically, the change in shape provides a decreased overall cabinet load as well as a decreased load per bottle. Moreover, the change in shape accommodates the increase in load required to freeze the phase change material 340.

It should be understood that a hexagonally shaped cooler with the zig-zag product configuration 370 or another product configuration may be used in conjunction with a conventional cooler refrigeration system. In such conventional systems, in contrast to the product shelves with frozen phase change material, a refrigeration system may supply cold air to the product space 220, which may then be circulated within the product space 220 to chill the products contained therein. The shelves in such conventional refrigeration systems may be wire shelves or other shelves that promote the circulation of cool air in a desirable flow path. Other components and other configurations may be used herein.

Figure 12:
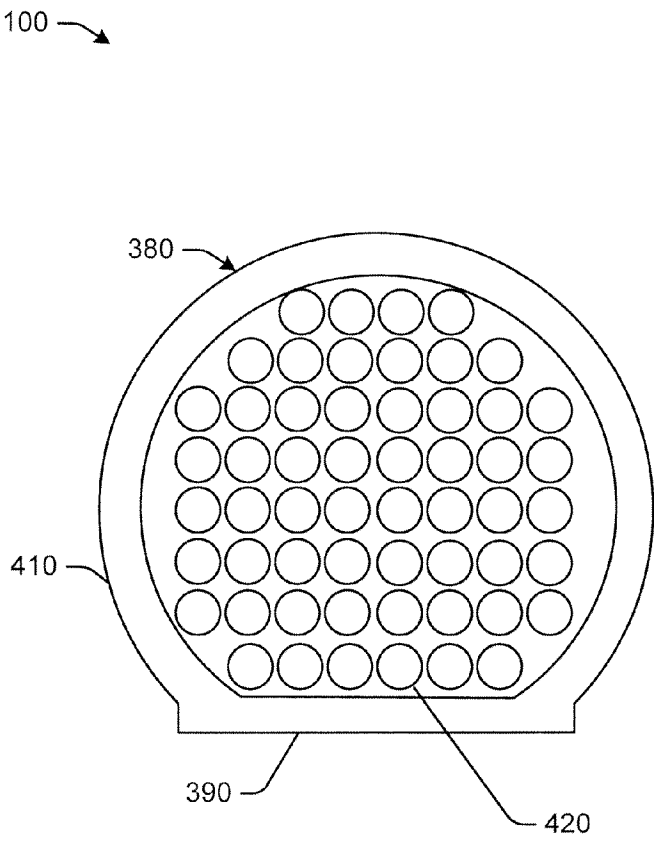
FIG. 12 is a top sectional view of an alternative embodiment of a cooler as may be described herein.
Figure 13:
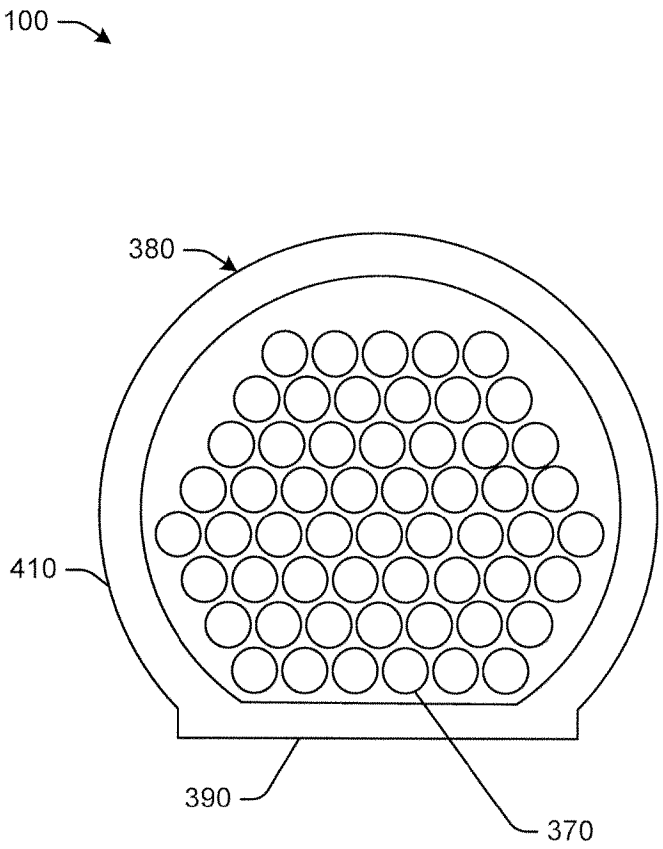
FIG. 13 is a top sectional view of an alternative embodiment of a cooler as may be described herein.

FIGS. 12 and 13 show alternative embodiments of the cooler 110. In these examples, the cooler 100 may be in the form of a D-shaped cooler 380. As is shown, the D-shaped cooler 380 may include a flat front panel 390 with a door 400 or a number of doors 400 positioned thereon. A transparent panel also may be used herein. The D-shaped cooler 380 further may include a semi-circular outer frame 410. FIG. 12 shows the D-shaped cooler 380 with a number of the products 10 positioned therein in a uniform row and column configuration 420. FIG. 13 shows the products 10 within the D-shaped cooler 380 having the zig-zag product configuration 370 described above. Other types of product configurations may be used herein. Both D-shaped coolers 380 may have less overall surface area as compared to a conventional square shaped cooler. Given such, both D-shaped coolers 380 may provide an improved load per product of about fifteen percent (15%) or more even with the differing product configurations. Other components and other configurations may be used herein.

Figure 14:
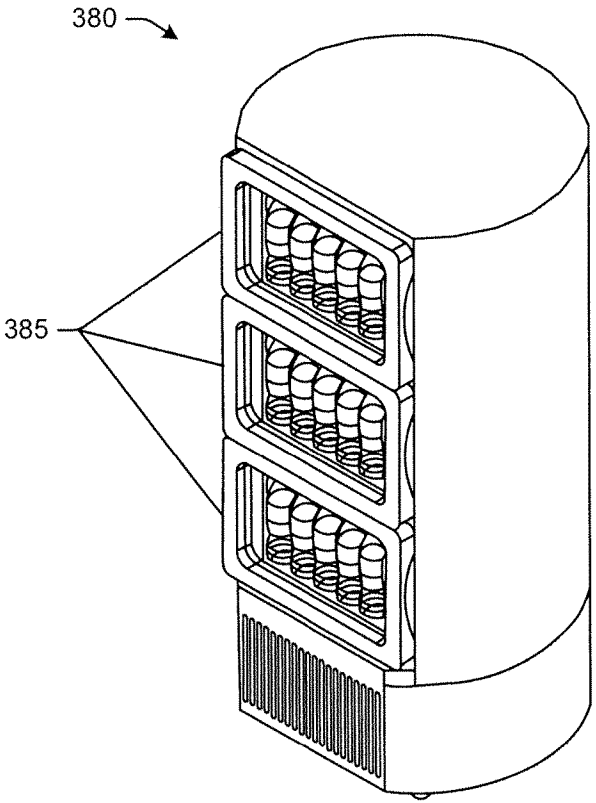
FIG. 14 is a perspective view of an alternative embodiment of a cooler as may be described herein.

As is shown in FIG. 14, the D-shaped cooler 380 or the other coolers described herein may include more than one door 400. For example, each shelf within the D-shaped cooler 380 or other coolers may have a shelf door 385. Such a configuration may increase the capacity of the D-shaped cooler 380 to keep cold as only the contents of a single shelf may be exposed to ambient conditions. Any number of the doors 400 may be used herein in any size, shape, or configuration.

Figure 15:
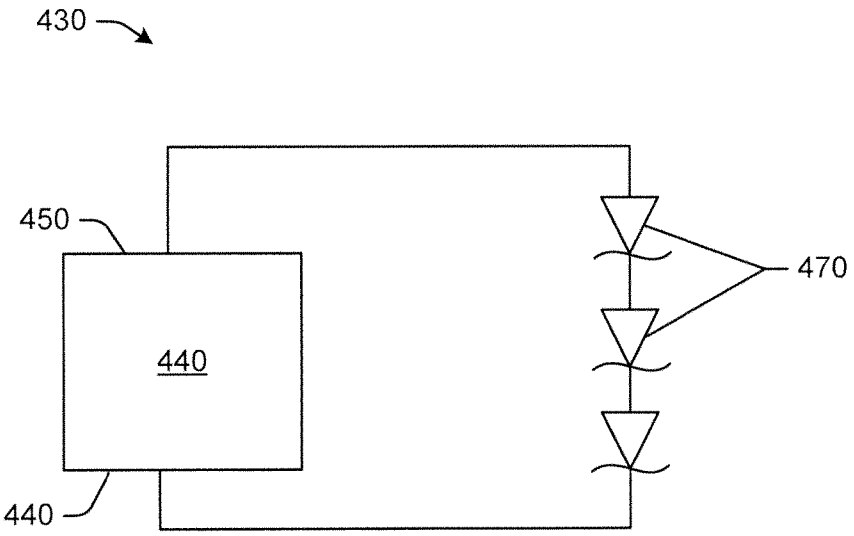
FIG. 15 is a schematic diagram of a Seebeck indicator for use with the cooler of FIG. 1.

FIG. 15 shows an example of a Seebeck indicator 430 for use with the cooler 100. As described above, the lighting inside a cooler 100, such as a glass door merchandiser, also goes off with the loss of electrical power. The lack of lighting, however, may make the products 10 therein unappealing and/or give the impression that the products 10 are not in a chilled condition. The Seebeck indicator 430 may resolve this perception issue by using the Seebeck effect to light up one or more light emitting diodes or other type of lighting fixture based upon the temperature differential between the outer frame 120 and the product space 220.

Specifically, the Seebeck indicator 430 may use a Peltier element 440. The Peltier element 440 may have a hot side 450 in thermal communication with the outer frame 120 and a cold side 460 in thermal communication with the product space 220. The Peltier element 440 may be in a circuit with one or more light emitting diodes 470. Based upon the temperature difference across the Peltier element 440, the Peltier element 440 may generate sufficient voltage so as to operate the light emitting diodes 470. The temperature differential generally may be about at least twenty degrees Celsius or so. Different types of converters and control circuits may be used herein. Other components and other configurations may be used herein.

The Seebeck indicator 430 thus provides a visual indication that the products 10 within the cooler 100 are in a chilled condition even if the electrical power to the cooler 100 is unavailable such that the cooler 100 is dark. For example, the light emitting diodes 470 may illuminate a sign or other type of indicator outside the cooler 100 stating "COLD BEVERAGES INSIDE" and the like. Any type of messaging indicia may be used herein. The greater the temperature differential, the greater the available power such that the brightness of the light emitting diodes 470 may vary with the temperature differential. The Peltier element 440 also may drive other types of loads so as to provide other types of indications. For example, audio indications may be used herein. Alternative power sources also may be used herein such as conventional batteries, super capacitors, and the like.

Figure 16:
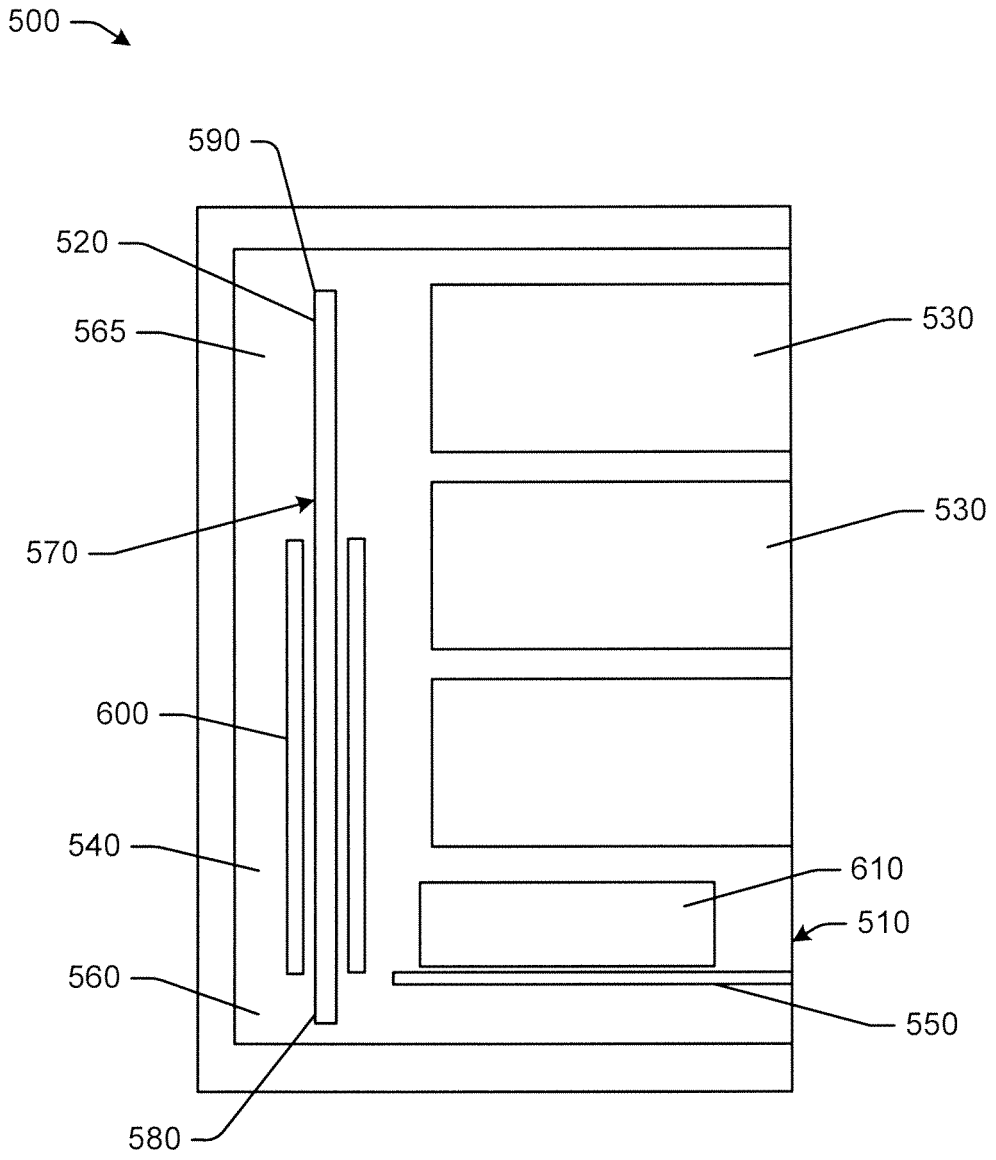
FIG. 16 is a sectional view of an alternative embodiment of a cooler as may be described herein with an ice based refrigeration system and a heat exchange body.

FIG. 16 shows an example of an alternative embodiment of a cooler 500 as may be described herein. The cooler 500 may include an ice based refrigeration system 510. As described above, known ice based systems generally provide for a block of ice to be installed at the top of the cooler so as to cool the contents of the cooler as the ice melts downward. Such a configuration, however, may mean that the cooler may be top heavy and/or require a significant footprint to remain stable.

The cooler 500 may include an outer frame 520. Positioned within the outer frame 520 may be a number of payload containers 530. The products 10 and other items to be chilled may be placed therein. The ice based refrigeration system 510 also may include a reservoir 540. The reservoir 540 may surround each of the payload containers 530 so as to chill the contents therein. The ice based refrigeration system 510 may include an ice rest 550. The ice rest 550 may be positioned about a bottom portion 560 of the reservoir 540. The ice rest 550 may include a number of apertures and the like so as to allow water to melt from the ice rest 550 and into the bottom portion 560 of the reservoir 540. The water below the ice rest 550 may be at about four degrees Celsius or so and hence very dense. The ice based refrigeration system 510 also may include a heat exchange body 570. A first end 580 of the heat exchange body 510 may be in the bottom portion 560 of the reservoir 540 while a second end 590 may be in thermal communication with a top portion 565. The heat exchange body 570 may be well insulated between the first end 580 and the second end 590 with one or more layers of insulation 600. Other components and other configurations may be used herein.

In use, a block of ice 610 may be positioned on the ice rest 550. The ice 610 keeps the bottom portion 560 of the reservoir 540 cold. The block of ice 610 may be formed over evaporator coils of a refrigeration circuit (not shown). One or more ice probes (not shown) may regulate the refrigeration circuit so as to turn on to build up the block of ice 610 or turn off once the block of ice has reached a predetermined size. Alternatively, the refrigeration circuit may be periodically operated so as to maintain a sufficiently large block of ice 610. The heat exchange body 570 then exchanges heat between the bottom portion 560 and the top portion 565 of the reservoir 540 so as to maintain each of the payload containers 530 in a chilled condition for an extended period of time. Moreover, the cooler 500 may be substantially stable given the positioning of the block of ice 610 at the bottom thereof Moreover, the cooler 500 may be taller given such stability. Specifically, the cooler 500 may be tall but somewhat shallow with a reduced footprint. The use of ice cubes or ice flakes may kick start and/or charge the ice based refrigeration system 510. A water, brine, water and glycol mixture, or other type of solution also may be used herein. Other components and other configurations may be used herein.

Figure 17:
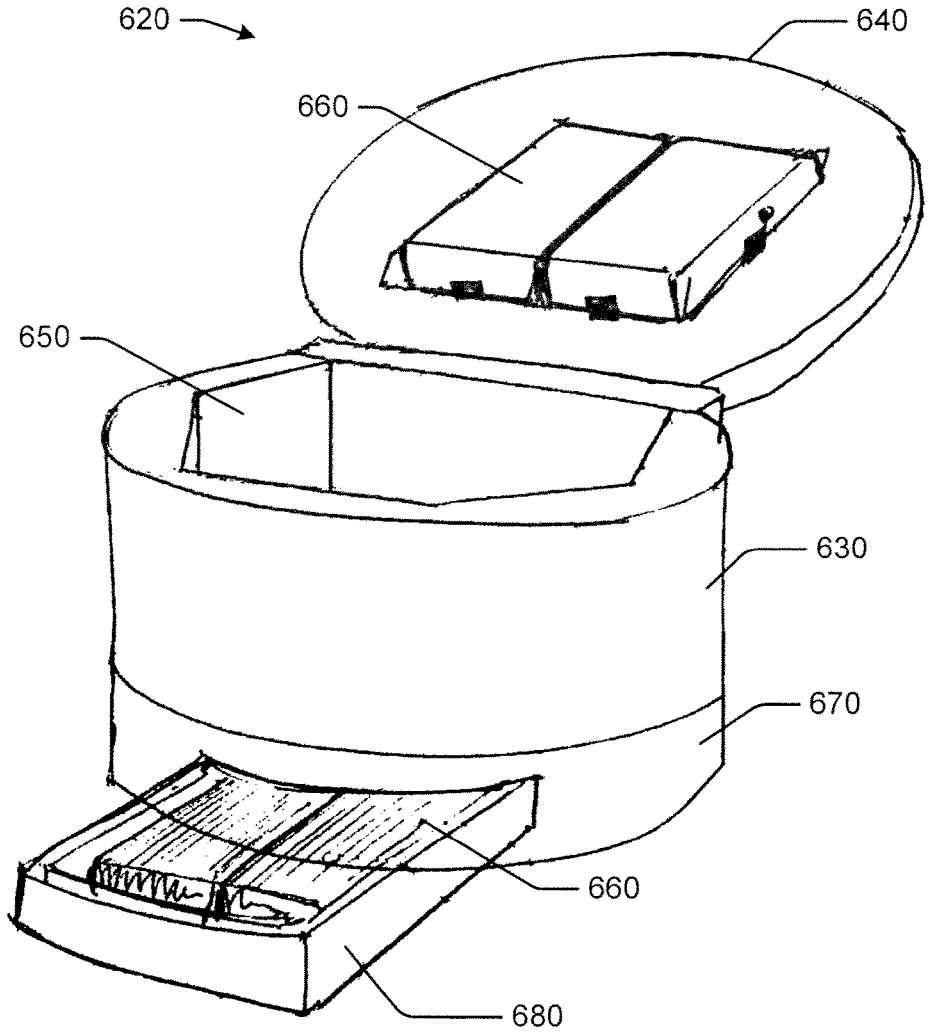
FIG. 17 is a perspective view of an alternative embodiment of a cooler as may be described herein.

FIG. 17 shows an example of an alternative embodiment of a cooler 620 as may be described herein. The cooler 620 may include an outer shell 630. The outer shell 630 may be in the form of a rectangle, a hexagon, a D-shape, or any suitable shape. The outer shell 630 may have a top door 640. Alternative, a front door or other type of access may be provided. Any of the doors also may have a transparent panel and the like. The cooler 620 may include a product space 650 therein. In this example, the product space 650 may be in the shape of a hexagon. Other shapes may be used herein.

The cooler 630 may be unpowered and without refrigeration components. Instead, the cooler 630 may use a number of replaceable phase change material packs 660 therein. In this example, one phase change material pack 660 may be mounted about the top door 640. A further phase change material pack 660 may be positioned about a bottom 670 of the product space 650. Specifically, the phase change material pack 660 may be positioned within a slidable drawer 680 positioned about the bottom 670 of the product space 650. Any number of phase change material packs 660 may be used herein. The cooler 630 also may have shelves therein such that the phase change material packs 660 may be slid or positioned therein. Other components and other configurations may be used herein.

In use, the frozen replaceable phase change material packs 660 may be slid or otherwise positioned within the cooler 630. The phase change material packs 660 keep the products therein chilled for an extended period of time. Positioning the products in the zig-zag product configuration 370 within the hexagonally shaped product space 650 further serves to keep the products therein cold. The phase change material packs 660 may be replaced upon melting and refrozen elsewhere. The phase change material packs 660 also may be used in any of the other coolers described herein or otherwise to kick start the pull down process and the like.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof The following numbered clauses set out further aspects of the invention (which may optionally be combined with other aspects) along with preferred and/or optional features thereof:

1. A cooler, comprising: an outer frame; a product space within the outer frame; the product space comprising a substantially hexagonal shape; and a plurality of product shelves positioned within the product space and adapted to support a plurality of products.

3. The cooler of clause 1, wherein the outer frame comprises the substantially hexagonal shape.

4. The cooler of clause 1, wherein the plurality of products are arranged a zig-zag configuration.

5. A cooler with a number of products therein, comprising: an outer frame; a product space positioned within the outer frame; and a Seebeck indicator in thermal communication with the outer frame and the product space to indicate the presence of chilled products therein.

6. The cooler of clause 5, wherein the Seebeck indicator comprises one or more light emitting diodes and a Peltier element.

7. The cooler of clause 6, wherein the Peltier elements illuminates the one or more light emitting diodes when the temperature difference between the outer frame and the product space is at least about twenty degrees Celsius.

8. The cooler of clause 6, wherein the Peltier element comprises a hot side in thermal communication with the outer frame and a cold side in thermal communication with the product compartment.

9. The cooler of clause 5, further comprising a number of shelf assemblies positioned within the product space and wherein the shelf assemblies comprise a phase change material and an evaporator.

10. A cooler, comprising: an outer frame; a product space within the outer frame; the product space comprising a substantially hexagonal shape; a plurality of products arranged in the product space in a zig-zag configuration; and one or more replaceable phase change material packs positioned about the product space.

11. A cooler with a number of products therein, comprising: an outer frame; a product space within the outer frame; a plurality of shelf assemblies positioned within the product space with the shelf assemblies comprising an evaporator and a phase change material therein; wherein the shelf assemblies comprise a top shelf assembly positioned about a top of the product space; and wherein the shelf assemblies comprise a plurality of self-contained shelf chambers.

12. The cooler of clause 11, wherein the number of products are arranged a zig-zag configuration.

13. The cooler of clause 11, wherein the product space comprises a hexagonal shape.

We claim:

1. A cooler, comprising:

an outer frame;

a product space within the outer frame;

a plurality of shelf assemblies positioned within the product space;

the plurality of shelf assemblies comprising an evaporator and a phase change material therein;

the plurality of shelf assemblies dividing the product space into a plurality of shelf chambers each having the evaporator and the phase change material on a top and a bottom thereof;

the plurality o shelf assemblies comprising a top surface and a bottom surface;

the phase change material being disposed within a plurality of phase change material cells position on top of and below the evaporator coil in the plurality of shelf assemblies between the top surface and the bottom surface of the plurality of shelf assemblies;

the plurality of shelf assemblies comprising one or more layers of insulation position about the plurality of phase change material cells between the top surface and the bottom surface e o the plurality of shelf assemblies;

the plurality of shelf assemblies comprising one or more spring loaded bolts positioned between the top surface and the bottom surface of the plurality of shelf assemblies; and the one or more spring load bolts being configured to accommodate thermal expansion and contraction of the plurality of phase change material cells.

2. The cooler of claim 1, wherein the outer frame comprises a hexagon shape.

3. The cooler of claim 1, wherein the outer frame comprises six or more sides.

4. The cooler of claim 1, wherein the outer frame comprises a door with a transparent panel.

5. The cooler of claim 1, further comprising a refrigeration system in communication with the evaporator.

6. The cooler of claim 1, wherein the phase change material comprises water.

7. The cooler of claim 1, wherein the plurality of shelf assemblies comprises a top shelf assembly with a top evaporator coil positioned about a top of the product space.

8. The cooler of claim 1, wherein the plurality of shelf chambers comprises a plurality of self-contained shelf chambers.

9. The cooler of claim 1, further comprising a plurality of products positioned in a zig-zag arrangement.

10. The cooler of claim 1, further comprising a plurality of products positioned in a uniform row and column arrangement.

11. The cooler of claim 1, wherein the outer frame comprises a D-shape.

12. The cooler of claim 1, further comprising a Seebeck indicator positioned about the outer frame and the product space.

13. The cooler of claim 1, wherein the plurality of phase change material cells comprise an open structure foam material soaked with water.

* * * * *